US007530469B2

(12) United States Patent
Naesje

(10) Patent No.: US 7,530,469 B2
(45) Date of Patent: May 12, 2009

(54) VALVE DEVICE HAVING TWO MEMBRANES FOR A DRINKING CONTAINER

(75) Inventor: Kjetil Naesje, Sandnes (NO)

(73) Assignee: SmartSeal AS (NO)

( * ) Notice: Subject to any disclaimer, the term of this patent is extended or adjusted under 35 U.S.C. 154(b) by 538 days.

(21) Appl. No.: 10/538,331

(22) PCT Filed: Dec. 9, 2003

(86) PCT No.: PCT/NO03/00409

§ 371 (c)(1),
(2), (4) Date: Mar. 8, 2006

(87) PCT Pub. No.: WO2004/067389

PCT Pub. Date: Aug. 12, 2004

(65) Prior Publication Data

US 2007/0007231 A1 Jan. 11, 2007

(30) Foreign Application Priority Data

Dec. 11, 2002 (NO) ..... 20025958

(51) Int. Cl.
*A47G 19/22* (2006.01)

(52) U.S. Cl. ..... 220/714; 137/455; 137/493.9; 220/253; 222/491

(58) Field of Classification Search ..... 137/455, 137/493.9; 215/11.4, 11.5, 297, 311, 387; 220/203.02, 203.11, 253, 367.1, 368, 711, 220/713, 714, 717; 222/491–497, 511, 513, 222/514, 518–521, 546–555, 566
See application file for complete search history.

(56) References Cited

U.S. PATENT DOCUMENTS 4,135,513 A 1/1979 Arisland (Continued)

FOREIGN PATENT DOCUMENTS

NO 137258 2/1978

(Continued)

*Primary Examiner*—Anthony D Stashick
*Assistant Examiner*—Elizabeth Volz
(74) *Attorney, Agent, or Firm*—Andrus, Sceales, Starke & Sawall, LLP

(57) ABSTRACT

An underpressure-activated valve device for a drinking container (32). The device consists of an outer membrane (2) and an inner membrane (4) that are placed at an axial distance from one another, and their peripheral attachment areas are pressure-sealingly interconnected, causing a reference pressure chamber (6) having at least one vent (8) to an ambient pressure P1 to exist between the membranes (2, 4). One membrane (2, 4) is fixedly connected to a flow pipe (10), and the other membrane (4, 2) is provided with a membrane opening (12) within which the pipe (10) is movably arranged. The membrane opening (12) is associated with a primary sealing body (18) for sealing against fluid flow via the pipe (10), and with a secondary sealing body (16) for sealing between the chamber (6) and an internal pressure P3 in the container (32). Both sealing bodies (16, 18) are placed in pressure-sealing contact with the pipe (10) when the valve device is in an inactive position of rest, while at least the primary sealing body (18) is placed in an open position when the valve device is in an active position.

7 Claims, 12 Drawing Sheets

U.S. PATENT DOCUMENTS 5,465,876 A 11/1995 Crisci
5,560,513 A 10/1996 Jarrell
5,607,073 A 3/1997 Forrer
5,747,083 A 5/1998 Raymond et al.
5,890,620 A 4/1999 Belcastro
5,975,369 A 11/1999 Yurkewicz et al.
6,305,570 B1 10/2001 Atkin et al.

FOREIGN PATENT DOCUMENTS

WO WO 0192133 A2 12/2001
WO WO 02098757 A1 12/2002

VALVE DEVICE HAVING TWO MEMBRANES FOR A DRINKING CONTAINER

CROSS REFERENCE TO RELATED APPLICATION

The present application is the U.S. national stage application of International Application PCT/N02003/000409, filed Dec. 9, 2003, which international application was published on Aug. 12, 2004 as International Publication WO 2004/067389. The International Application claims priority of Norwegian Patent Application 20025958, filed Dec. 11, 2002.

FIELD OF THE INVENTION

This invention regards a valve device for a drinking container, in which the valve device is based on the use of two cooperating valve membranes, and in which, among other things, the device prevents unintentional outflow of a fluid, typically a liquid, from the drinking container. Also, the device is automatically vented, either during the fluid outflow or immediately afterwards. For instance, the drinking container may be a drinking pouch, a drinking carton, a cup or a bottle. As an example, the device may be provided within, shaped as or connected to a cap or a drinking spout, thereby allowing it to easily replace an ordinary cap or drinking spout for a drinking container. The present device allows for spill-free consumption of the fluid from the drinking container, resulting in great hygienic advantages, among other things.

Fluid outflow from the drinking container is initiated and controlled by supplying a valve-activating underpressure to the valve device, preferably by a user placing his/her lips around the device and sucking an underpressure that generates a valve-activating suction force. The outflow stops when the suction force ceases, whereupon the valve device causes the outflow opening of the drinking container to be sealed, even at an overpressure in the container. The device may also be arranged so as to provide continuous venting of the drinking container during consumption. It may also be arranged causing it to puncture an area of the drinking container when opened first time.

PRIOR ART AND DISADVANTAGES THEREOF

The patent literature describes various devices for preventing liquid from flowing out of a drinking container. Such devices are described in U.S. Pat. Nos. 5,975,369 and 5,465,876, among others. However, these devices do not include an automatic underpressure-controlled closing mechanism, and the user therefore must carry out a mechanical movement in order to open and close these. Prior art also comprises devices having automatic closing functions, but these suffer from other disadvantages, including being sensitive to pressure differences, being relatively complex and requiring specially designed containers. U.S. Pat. No. 5,607,073 discloses an example of such a device. Moreover, Norwegian patent no. 137258 describes a device that prevents liquid from leaking out, even when the liquid in the container is pressurised. However, this type of device is arranged in a manner that allows any liquid overpressure in the container to increase the valve-closing force sufficiently for a user to have difficulties opening the valve. All of these known valve devices are technically complex. Hence, they are relatively expensive to manufacture, making them unsuitable for disposable use.

OBJECTS OF THE INVENTION

An object of the invention is to remedy said disadvantages of prior art.

In particular, an object of the invention is to provide a valve device that allows spill-free consumption of a fluid from a drinking container, thereby ensuring that no fluid residues remain in the valve device to give rise to unhygienic conditions.

Another object is to provide a valve device that, as much as possible, is formed, from the same materials and from a minimum number of components, which provides technically advantages in the manufacturing thereof.

A further object of the invention is to provide a valve device that exploits small pressure differences in connection with relatively large pressure-sensitive surfaces in order to provide relatively large valve-activation forces.

How To Achieve the Objects

The objects are achieved by means of features disclosed in the following description and in subsequent claims.

Preferably, the present valve device is formed within, formed as or in connection with a cap, a drinking spout or as part of the cap or the drinking spout. The valve device includes two cooperating, flexible pressure-sensitive valve membranes constituting an outer membrane and an inner membrane, respectively. The reference to "outer" and "inner" denote their position relative to an outflow opening in an associated drinking container. Preferably, the membrane is formed within, formed as or in connection with a cap or a drinking spout, possibly as a part thereof.

The membranes are placed at an axial distance from one another, and their peripheral attachment areas are pressure-sealingly interconnected. This constellation defines a reference pressure chamber located between the membranes and inside of their attachment areas. The reference pressure chamber is provided with at least one vent at the attachment areas of the membranes and outside of their activation surfaces, the vent(s) connecting the reference pressure chamber with the ambient pressure P1, normally atmospheric pressure, of the drinking container. In position of use, said attachment areas are connected to the outflow opening of the drinking container, causing fluid outflow from the drinking container and venting thereof to take place via the valve device.

One of the two membranes is fixedly connected to a through-put flow pipe, through which a fluid in the drinking container may flow when the valve device is open. The other of the two membranes is provided with a through-going membrane opening within which said flow pipe is movably arranged when in the position of use. The membrane opening is associated with a primary sealing body arranged to seal against fluid flow via the flow pipe, and with a secondary sealing body arranged to provide a seal between said reference pressure chamber and an internal pressure P3 in the drinking container. When the valve device is in an inactive position of rest, both sealing bodies are placed in pressure-sealing contact with the flow pipe.

By applying an underpressure P2 onto the outside of the outer membrane, the valve device is activated. This is done by means of applying the underpressure P2 on the outside of said outer membrane, causing it to move relative to the inner membrane. Preferably, a user sucks an underpressure on the outside of the outer membrane. This relative movement separates the primary sealing body from the flow pipe and opens up to fluid outflow.

Moreover, the valve device is arranged in a manner allowing its secondary sealing body to be in pressure-sealing and moveable contact with the flow pipe, at least during incipient opening of the valve device, and when the primary sealing body is placed in an open position. As a result, the secondary sealing body may be placed in a permanent, pressure-sealing and moveable contact with the flow pipe, and when the valve device is both in the active and the inactive position. The valve device may also be arranged in a manner allowing the secondary sealing body to open to venting from said reference pressure chamber by means of opening the valve device further. This may be achieved by providing the flow pipe with a reduced diameter, at least at the free end portion thereof. For example, this may be done by providing this end portion of the flow pipe with a recessed area having a uniformly reduced outer diameter, or by providing the outside of the pipe with a conical shape having progressively decreasing outer diameter towards the free end portion thereof. Depending on the particular valve device design, venting the drinking container may take place in various ways. The venting may be carried out after finishing the fluid consumption, but before the valve device assuming its position of rest, or the venting may take place concurrent with the fluid consumption.

The interaction of the membranes, and various types of venting, are described more detailed in the following examples of embodiments. The principle mode of operation for the valve device is described thoroughly in the first embodiment example, and with reference to FIGS. 1-5.

Furthermore, the valve device may be provided with a protective cover to prevent dust and bacteria from settling onto the outer membrane. A protective cover may also be used to indicate preceding opening and use of the valve device. Also, the protective cover may be provided with an internal fastening device, for example an extrusion, which is in physical, possibly sealing, contact with the outer membrane, and which keeps the cover in place. An extra security against leakage during storage and transport of the drinking container and the valve device thus is achieved. At the same time, the valve device is protected against any physical contact that may cause mechanical malfunction.

The inner membrane has several tasks. At an overpressure in the drinking container, it must at least form a pressure-sealing barrier between the drinking container and the surroundings during transport and storage. At an underpressure in the drinking container, the inner membrane must also be able to move inwards toward the drinking container to facilitate venting and to equalize the pressure therein. The inner membrane may also be provided with a point or a pin of sufficient rigidity to puncture the drinking container or to break through a puncture area thereof.

In the following, five non-limiting examples of preferred embodiments of the invention are described.

SHORT DESCRIPTION OF THE DRAWINGS

The embodiments are illustrated by the following drawings, in which:

FIG. 1 is a front view showing a cross section through a first embodiment of a valve device according to the invention, in which the device is shown in an inactive, valve-closing position of rest, and is connected to an outflow opening in a non-pressurised container (not shown), and in which the device is designed for continuous venting;

FIG. 2 also shows the valve device according to FIG. 1, but in here the device is shown in an active, valve-opening position when a user applies an underpressure P2 to the device and consumes a liquid from the drinking container;

FIG. 3 also shows the valve device according to FIG. 1, but in here the device is shown in an active, valve-opening position during venting of the drinking container immediately after completing the liquid consumption;

FIG. 4 also shows the valve device according to FIG. 1, but in here the device is shown in an active, valve-opening position while consuming and venting simultaneously;

FIG. 5 also shows the valve device according to FIG. 1, in which the device is shown in an inactive, valve-closing position of rest, but in here the device is connected to an outflow opening in a pressurised drinking container (not shown), the flexible membranes of the valve device thereby bulging outwards relative to the container;

Figure 8:
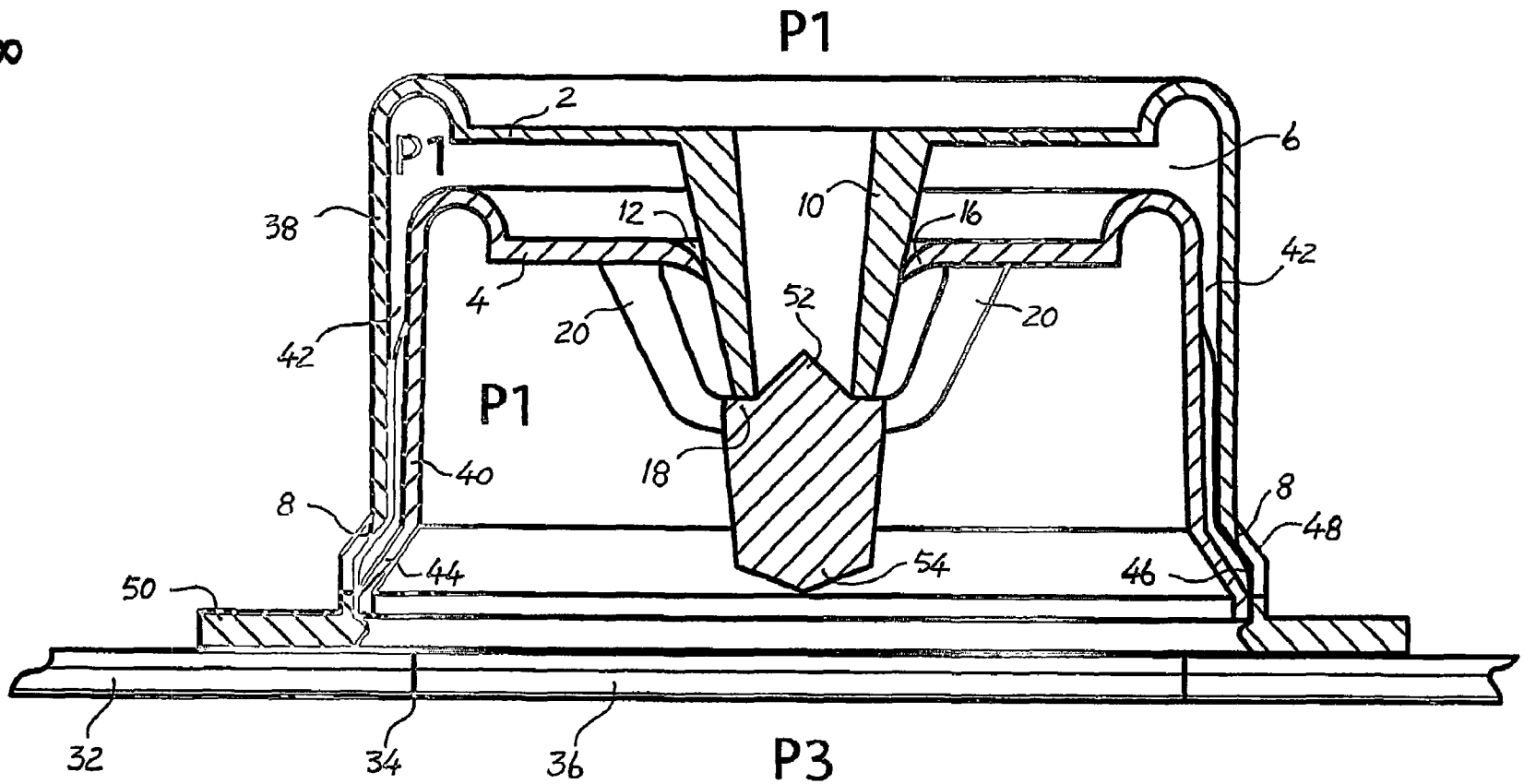
Figure 9:
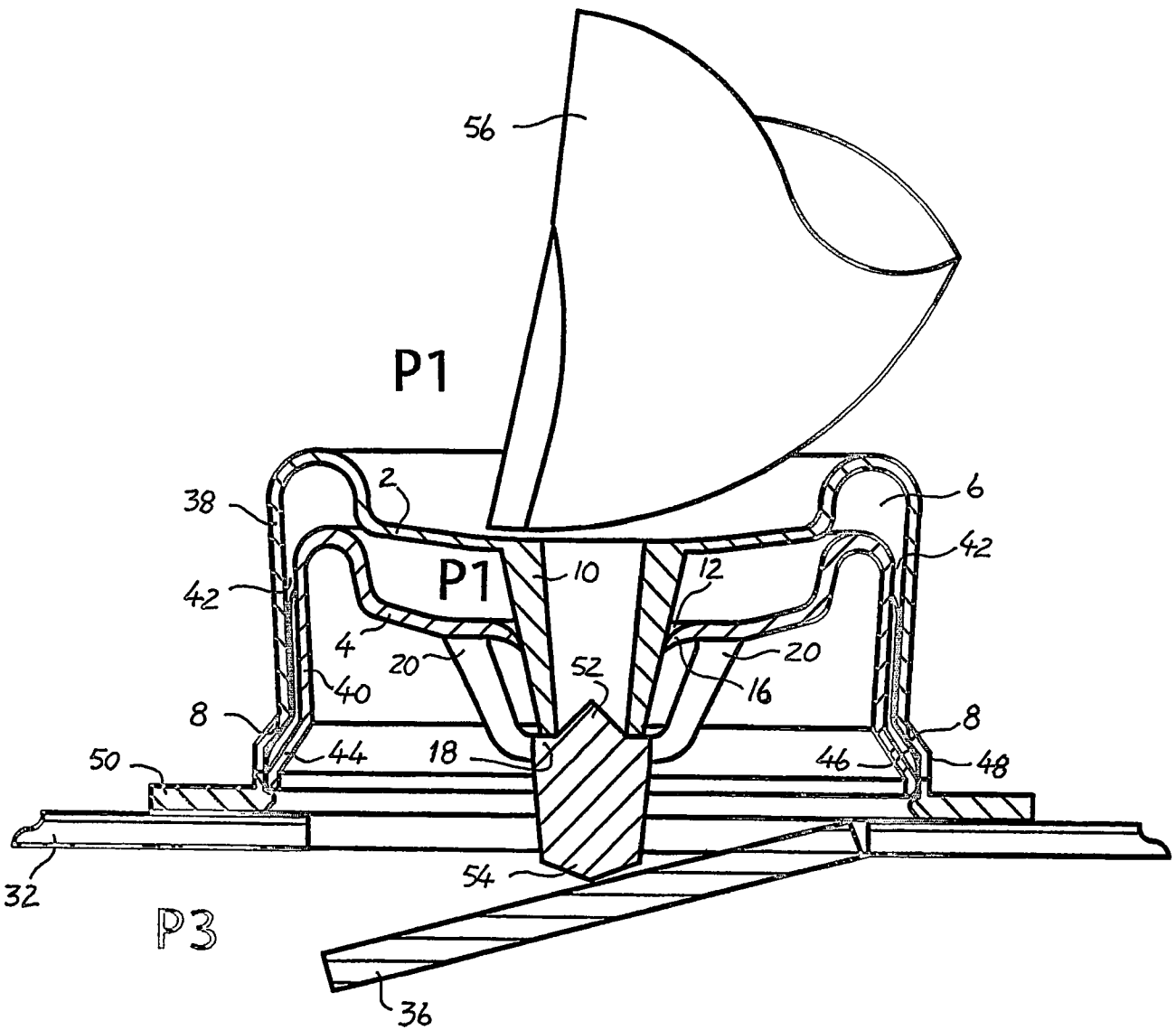
Figure 10:
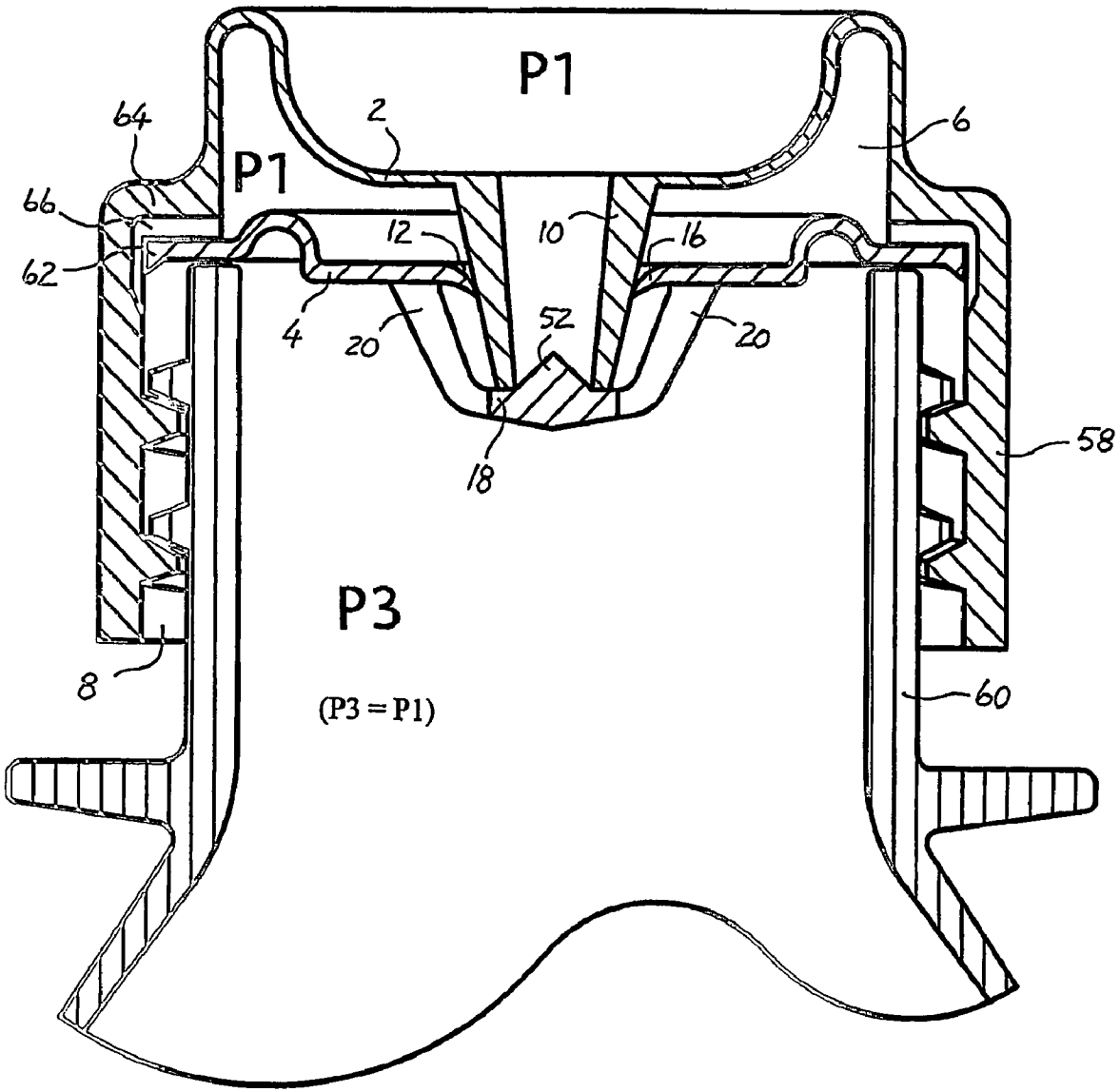
Figure 11:
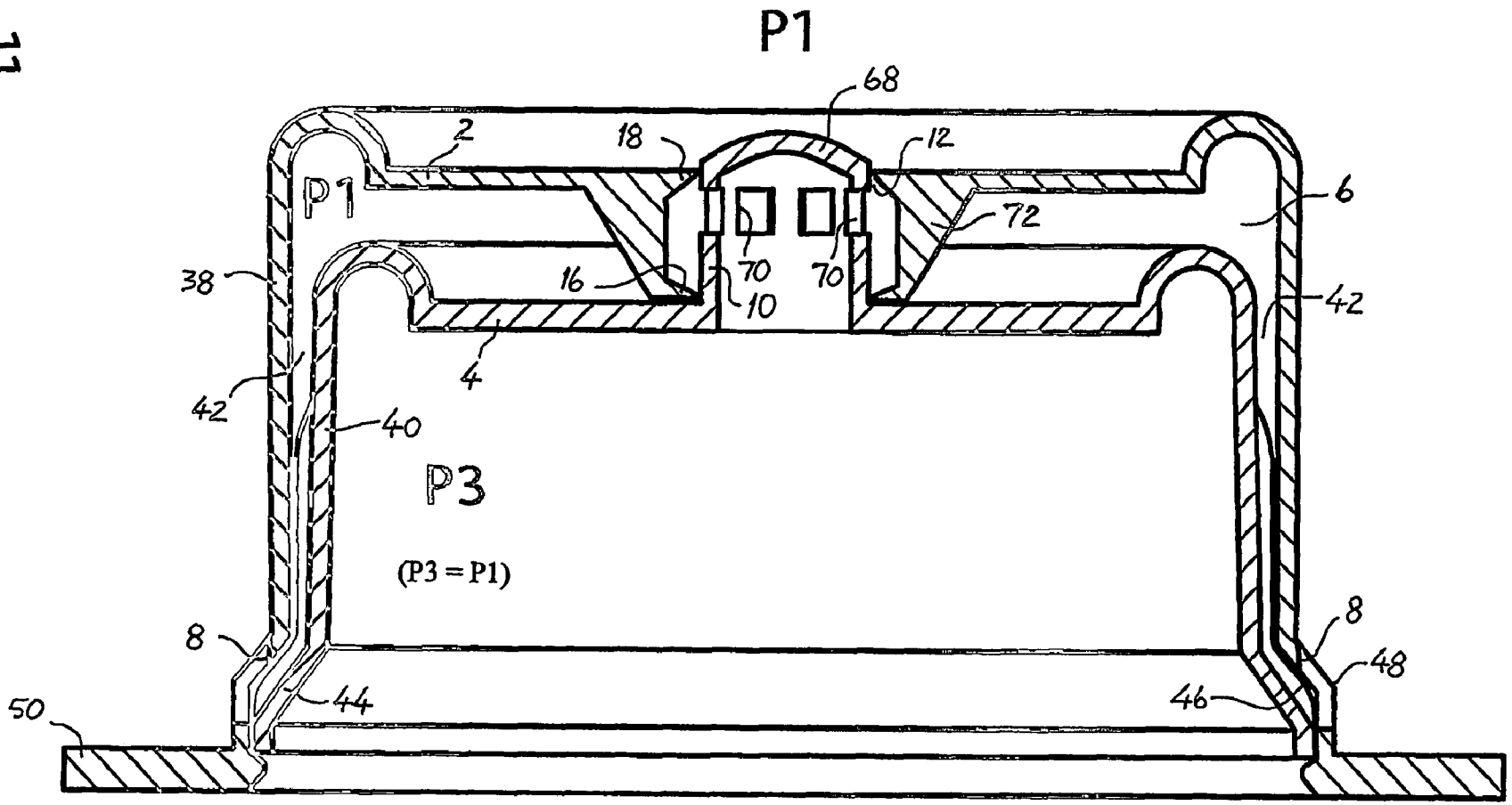
Figure 12:
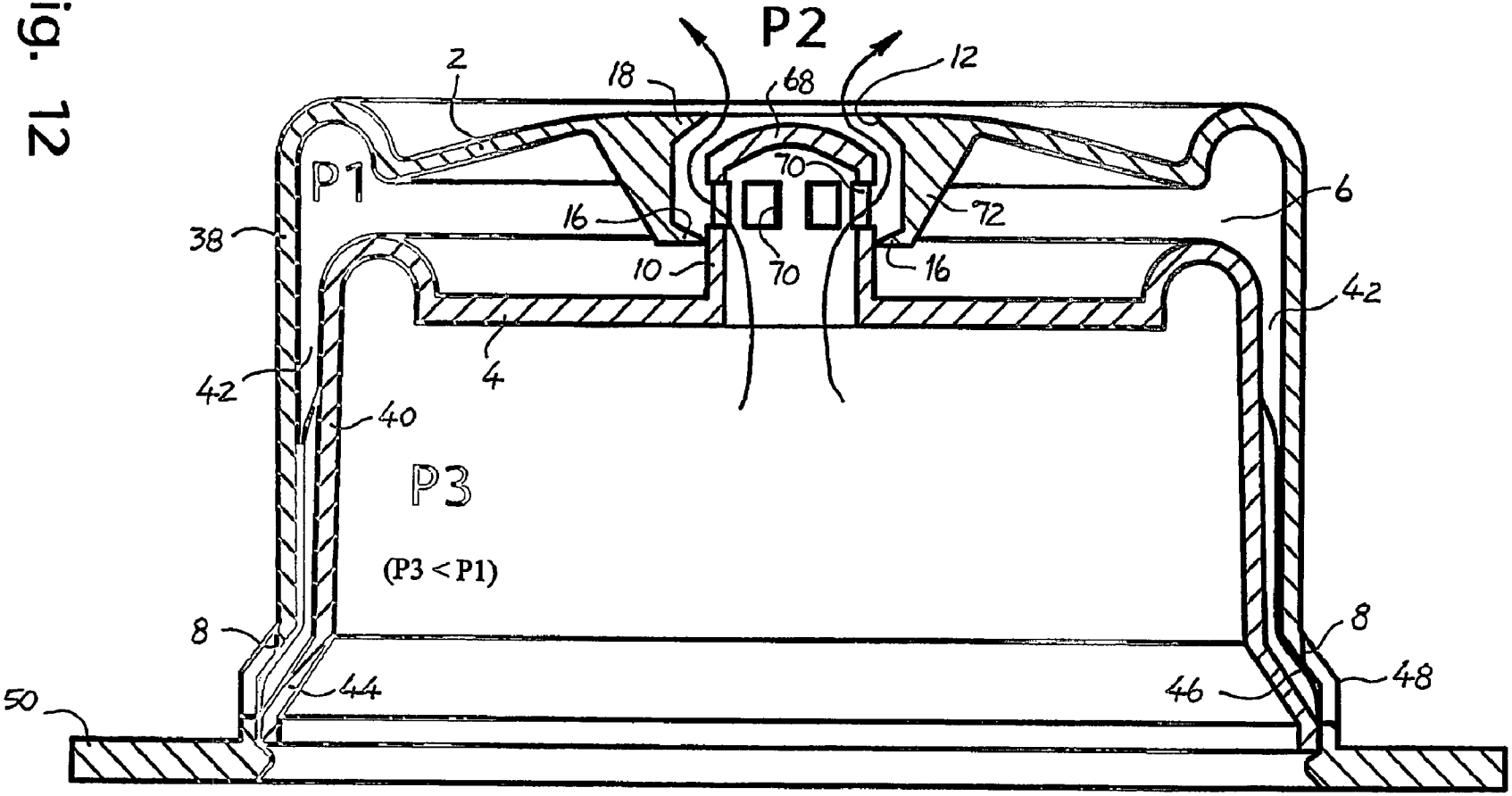

FIG. 8 is a front view showing a cross section through a third embodiment of a valve device according to the invention, in which the device is shown in an inactive, valve-closing position of rest, and is connected to an unpunctured puncture area of a drinking container, and in which the device is provided with a perforation pin in order to puncture said puncture area, thereby providing an outflow opening in the drinking container;

FIG. 9 shows the valve device according to FIG. 8 during puncturing of said puncture-adapted wall area of the drinking container;

FIG. 10 is a front view showing a cross section through a fourth embodiment of a valve device according to the invention, in which the device resembles the valve device according to FIG. 8, and in which the device is shown in an inactive, valve-closing position of rest, and is connected to a threaded bottleneck of a non-pressurised bottle;

FIG. 11 is a front view showing a cross section through a fifth embodiment of a valve device according to the invention, in which the device is shown in an inactive, valve-closing position of rest, and is connected to a non-pressurised drinking container (not shown); and FIG. 12 shows the valve device according to FIG. 11, but in which the device is shown in an user-activated valve-opening position.

The figures are schematic and may therefore be somewhat distorted in terms of size of details, relative dimensions, shape and their relative positions relative to one another. In the following, similar details of the figures substantially will be denoted by the same reference numerals.

EXAMPLES OF EMBODIMENTS OF THE INVENTION

The components shown in the following examples of embodiments may also be used in yet further combinations than those disclosed herein.

Besides showing a first example of an embodiment of the present valve device, FIGS. 1-5 also illustrate the principle mode of operation for the valve device before, during and after a user applies/has applied a valve-activating underpressure P2 to the device.

Figure 1:
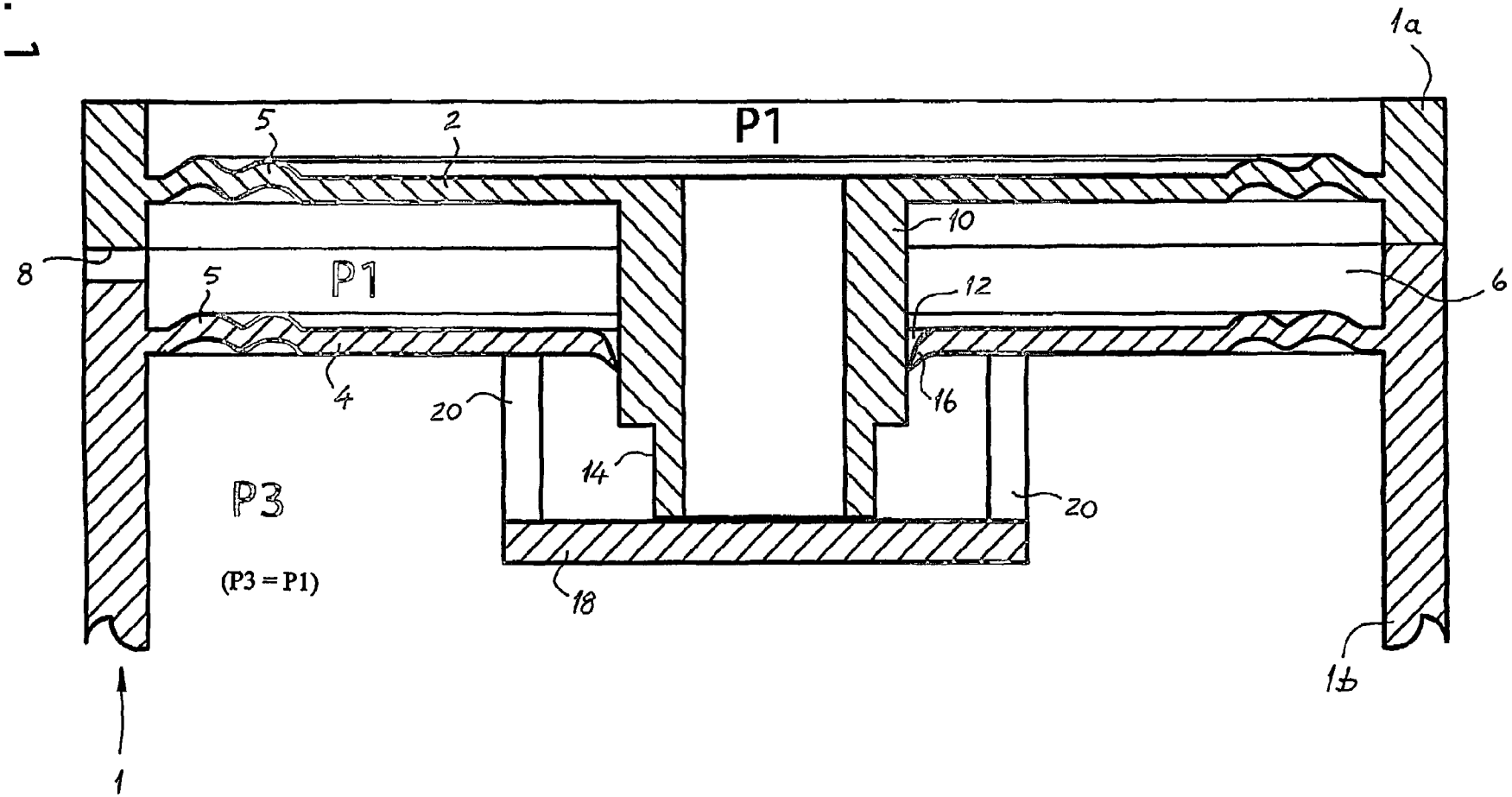

FIG. 1 shows the present valve device arranged as a cap 1 (partially shown) for an outflow opening in a non-pressurised drinking container (not shown). Among other things, the valve device includes two cooperating membranes constituting an outer membrane 2 and an inner 4 membrane, respectively. Both membranes 2, 4 are built-in and are connected directly onto the wall of the cap 1, and they are arranged at an axial distance from one another. In this example, the bodies 2, 4 consist of flexible, circular surfaces being substantially parallel and planar. Both membranes 2, 4 are provided with concentric, ring-shaped corrugations 5 that stretch radially and straighten out when the bodies 2, 4 are activated and are moved axially. Axial and radial movement refers to an imaginary centre line through the cap 1, and the membranes 2, 4 of this example are arranged concentrically about this centre line. Said outer membrane 2 is formed in an outer cap part 1*a*, while the inner membrane 4 is formed in an inner cap part 1*b*. The outer cap part 1*a* is connected pressure-sealingly onto the outside of the inner cap part 1*b*. A reference pressure chamber 6 thus exists between the membranes 2, 4 and within the cap 1. The reference pressure chamber 6 communicates with the ambient pressure P1 of the drinking container, normally atmospheric pressure, via at least one vent 8 in the wall of the cap 1. The internal pressure P3 of the drinking container may be greater or smaller than the ambient pressure P1. In the figures, P2 indicates a user-applied underpressure that is used to activate the valve device. A pervasively open flow pipe 10 is also fixedly connected to the other membrane 2 and is placed in the centre thereof, and the pipe 10 projects outwards at right angles from the membrane 2 and in through a corresponding and through-going membrane opening 12 in the inner membrane 4. At the inwardly projecting, free end portion thereof, the flow pipe 10 is provided with a recessed area 14, in which the pipe 10 has a uniformly reduced outer diameter. The flow pipe 10 is also axially moveable relative to the membrane opening 12 and pressure-sealingly bears against a secondary sealing body 16 associated with the inner membrane 4. The secondary sealing body 16 is in the form of a flexible, ring-shaped sealing lip defining the membrane opening 12. Furthermore, the inner membrane 4 is provided with a primary sealing body 18 in the form of an ring-shaped plate. In this example the sealing plate 18 is placed on the inside of the inner membrane 4. The sealing plate 18 is provided with several axial stays 20 that are distributed along the periphery thereof, and that connect the plate 18 to the inner membrane 4. This allows liquid to flow between the stays 20 and through the flow pipe 10 when the valve device is in an open position. In FIG. 1, however, the valve device is shown in a position of rest, in which the inwardly projecting, free end portion of the pipe 10 is placed pressure-sealingly against the sealing plate 18 and is blocking any liquid outflow through the pipe 10.

Figure 2:
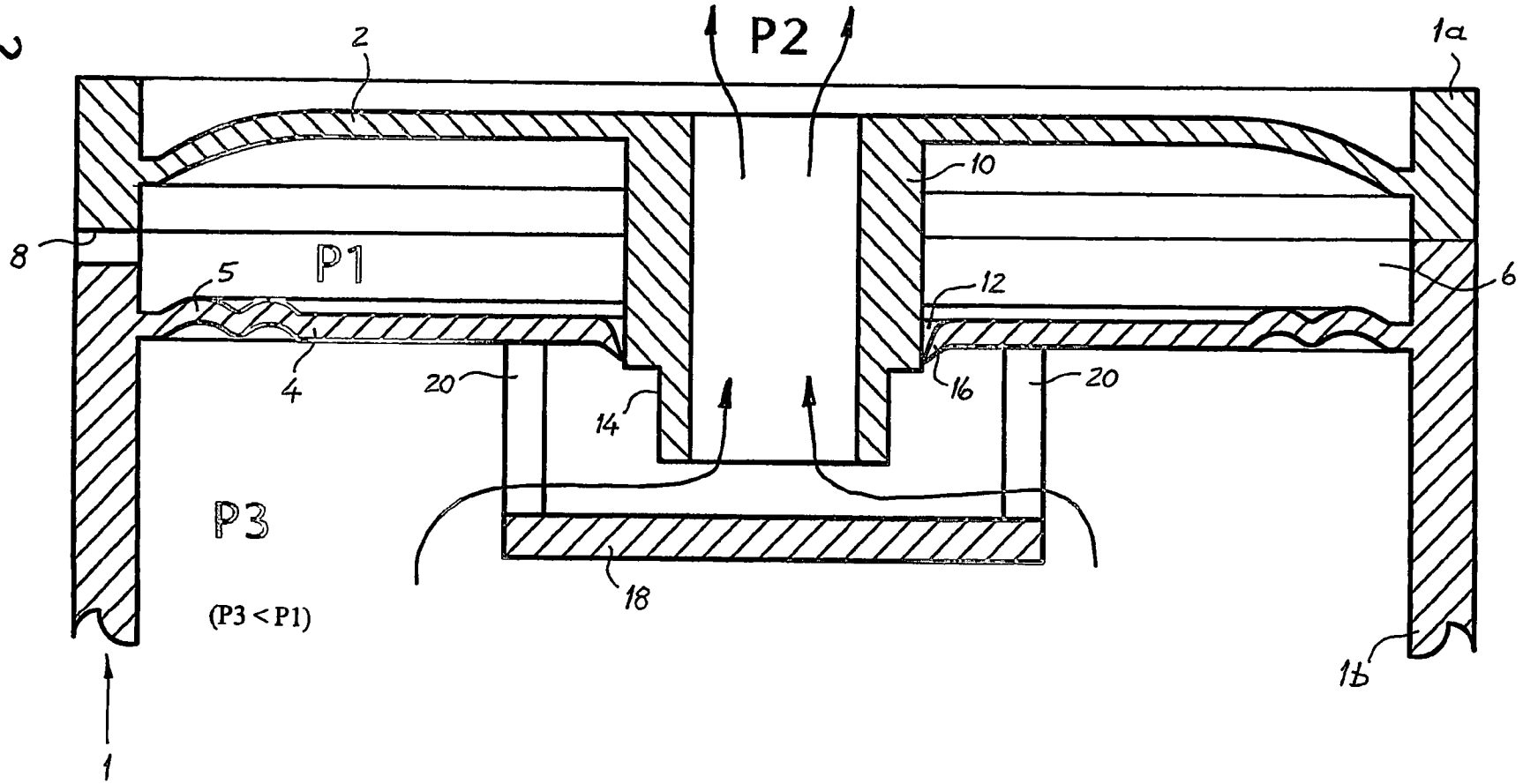

FIG. 2 shows the valve device in the open position during consumption of liquid from the drinking container. However, the figure shows the valve device during incipient and/or moderate underpressure-activation. The user applies an underpressure P2 to the outside of the outer membrane 2 simultaneous with admitting atmospheric air at pressure P1 into the reference pressure chamber 6 via the vent 8. A pressure difference P1-P2 thereby acts across the outer membrane 2 and moves the membrane 2 and its flow pipe 10 axially outwards. Simultaneously, the corrugations 5 of the membrane 2 are stretched radially, causing the membrane 2 to bulge outwards. Thereby, the free end portion of the flow pipe 10 is lifted away from said sealing plate 18, allowing liquid to flow out of the pipe 10. The flow direction of the liquid is indicated with downstream-directed arrows. FIG. 2 shows the flow pipe 10 during the incipient axial movement, in which said sealing lip 16 only is in contact with the flow pipe 10 at the largest diameter thereof, which is outside of said recessed area 14, and in which relative movement along the largest diameter area will take place during moderate underpressure-activation of the valve device.

Figure 3:
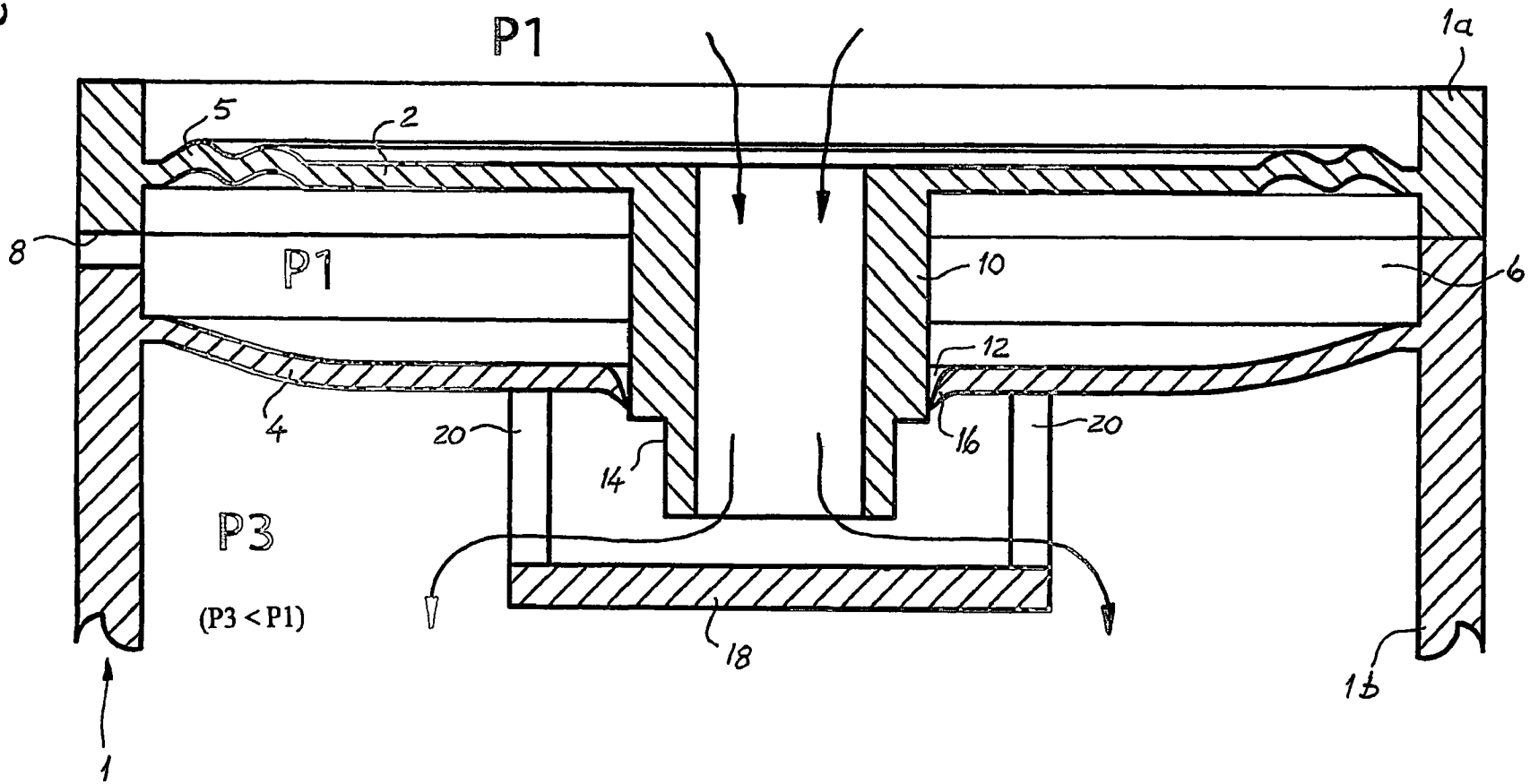

FIG. 3 shows the valve device immediately after completing the liquid consumption according to FIG. 2, but before the device closes its outflow opening. At this stage of valve operation, the pressure P3 of the drinking container is less than the ambient pressure P1 due to removal of liquid from the container. However, the reference pressure chamber 6 and the outside of the outer membrane 2 are exposed to the ambient pressure P1. This pressure constellation creates a pressure difference P1-P3 that drives air and any liquid residues into the drinking container via the flow pipe 10, and that also presses the inner membrane 4 into the drinking container and causes it to bulge. In the figure, the flow direction of the air is indicated with downstream-directed arrows. Gradually, this pressure equalization will cause the membrane 4 to be moved back to its position of rest, and it will cause said sealing plate 18 once again to be brought into pressure-sealing contact with the flow pipe 10 and closing the valve device.

Figure 4:
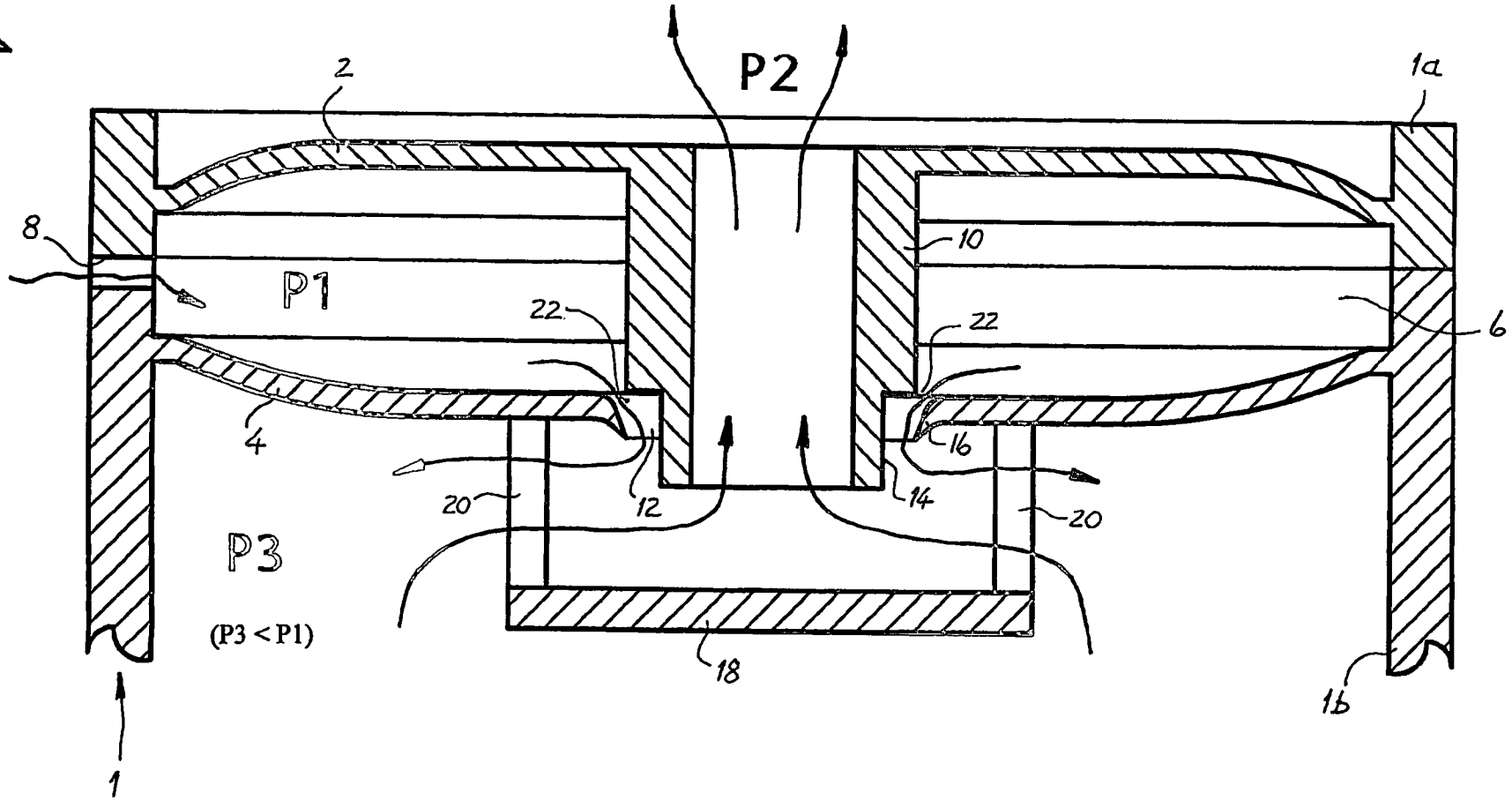

FIG. 4 shows the valve device in the open position during simultaneous liquid consumption and venting (continuous venting), but in here the valve device is exposed to strong and/or continuous underpressure-activation. As shown in FIG. 2, an underpressure P2 is applied to the outside of the outer membrane 2 simultaneous with admitting air at a pressure P1 into the reference pressure chamber 6 via the vent 8. In this case however, and as a consequence of the continuous liquid consumption, the container pressure P3 is less than the pressure P1 of the reference pressure chamber 6. This pressure constellation creates an outwardly directed pressure difference P1-P2 across the outer membrane 2 and an inwardly directed pressure difference P1-P3 across the inner membrane 4, causing both membranes 2, 4 to be activated and to bulge outwardly away from one another. Placed in these activated positions, said recessed area 14 of the pipe will be positioned directly opposite said sealing lip 16. Thereby, a vent gap 22 will exist between the flow pipe 10 and the sealing lip 16. Thereby, air from the reference pressure chamber 6 may flow into the drinking container via the gap 22 to equalize the underpressure in the container. Air passes through gap 22 as long as consumption takes place, and as long as sufficient underpressure exists in the drinking container. Arrows in the figure indicate the downstream flow directions of the air and the liquid.

Figure 5:
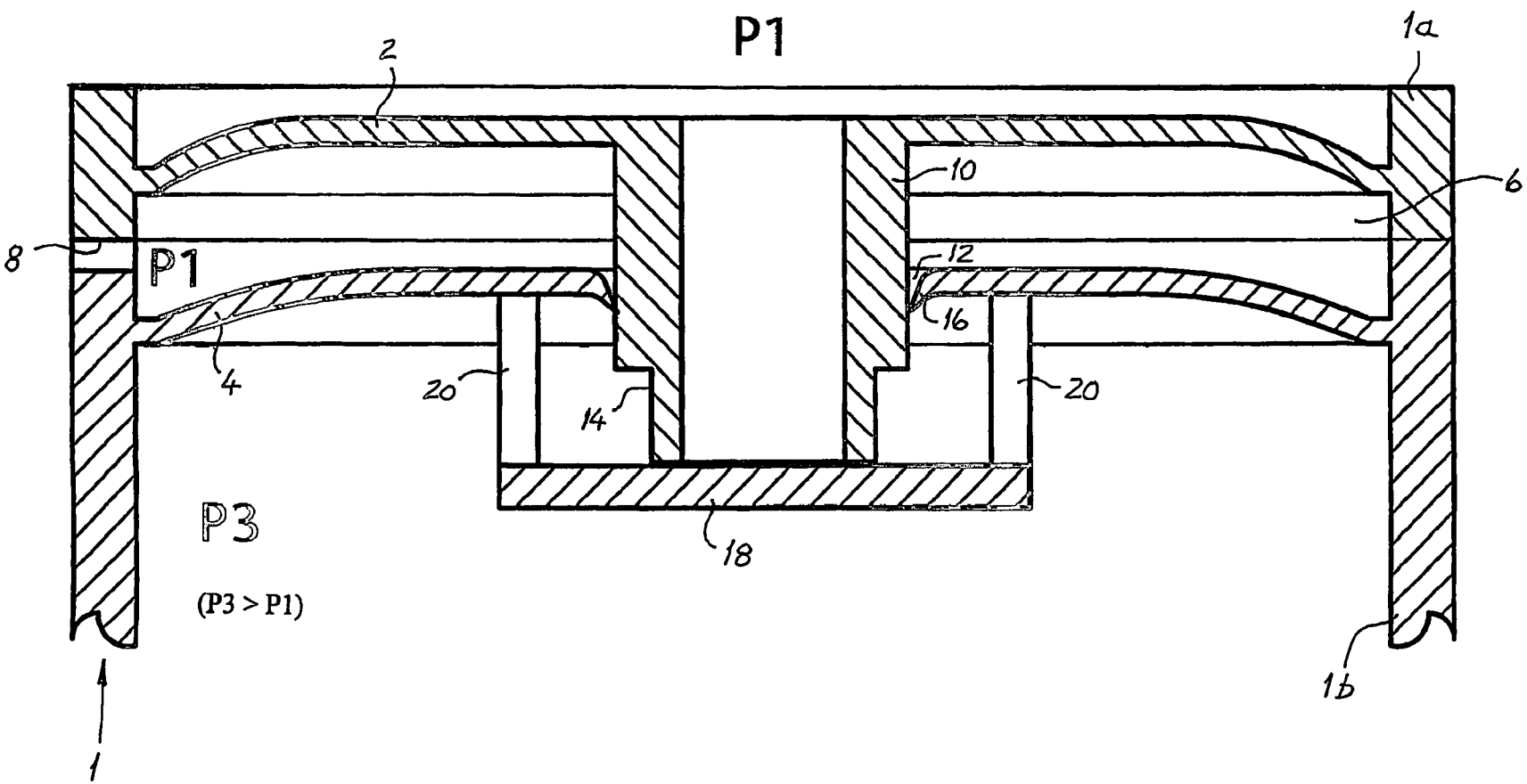

FIG. 5 shows the valve device connected to a pressurised drinking container (not shown), in which the container pressure P3 is greater than the ambient pressure P1. This pressure constellation creates an outwardly directed pressure difference P3-P1 that acts directly on the inner membrane 4 and indirectly (via the flow pipe 10) on the outer membrane 2. Thus, both membranes 2, 4 bulge outwards, and said sealing plate 16 is pressed against the flow pipe 10 with a greater force than that of the drinking container when not pressurised. The valve-closing force thus will increase with increasing pressure P3 in the drinking container.

Figure 6:
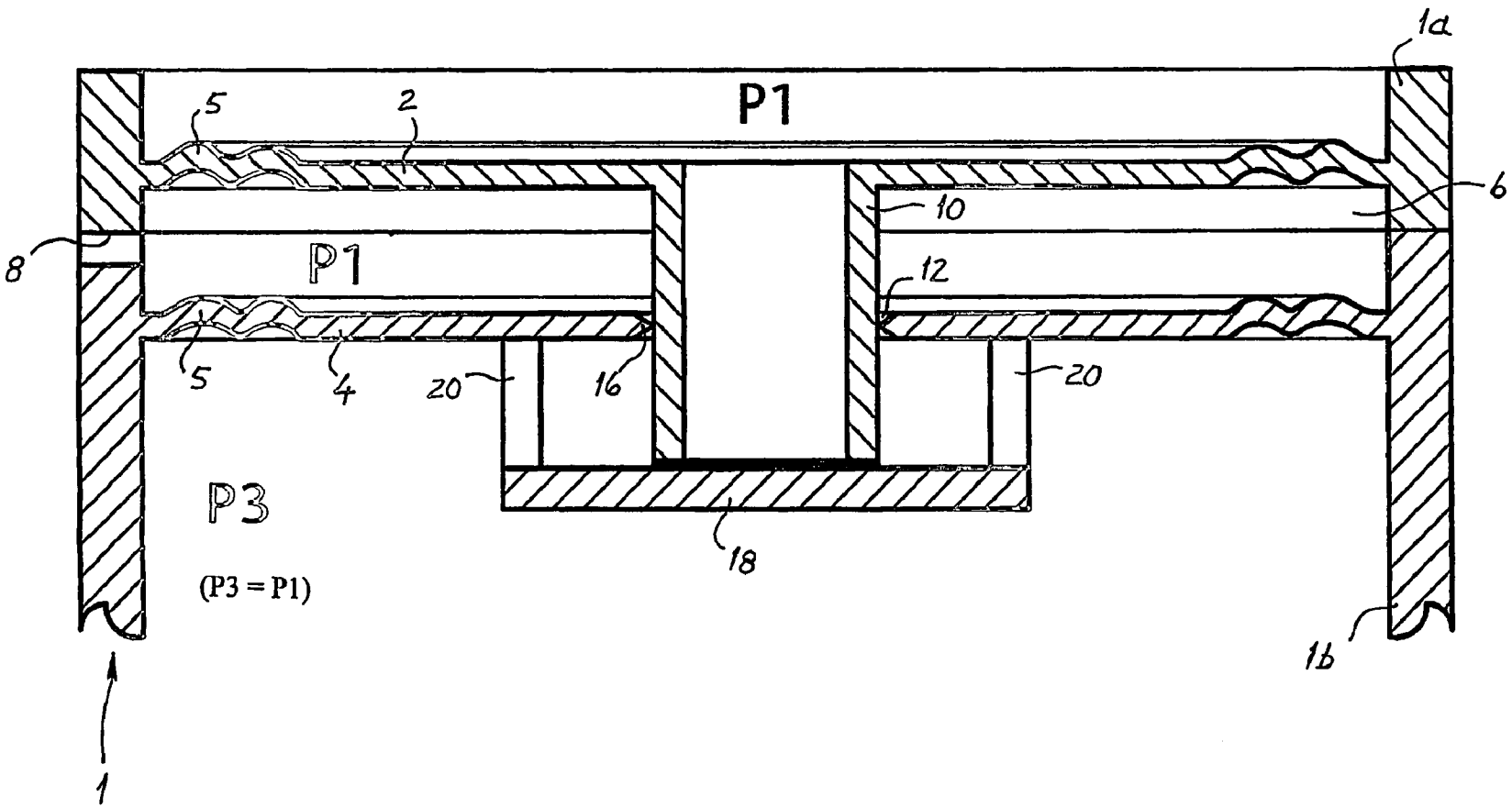
FIG. 6 is a front view showing a cross section through a second embodiment of the valve device according to the invention, in which the device is shown in an inactive, valve-closing position of rest, and is connected to an outflow opening in a non-pressurised container (not shown), but in which the device is not designed for continuous venting of the drinking container during liquid consumption.

FIG. 6 shows a second example of an embodiment of a valve device according to the invention. This valve device is very similar to the device according to FIG. 1 and is arranged as a cap 1. However, the flow pipe 10 of the device is not provided with an external recessed area at the inwardly projecting, free end portion thereof. The flow pipe 10 according to FIG. 6 has a uniform outer diameter and thus is not arranged for continuous venting of the drinking container during liquid consumption. In some cases, for example in connection with drinking pouches, it may be desirable to avoid contaminated liquid from being sucked into the drinking container after completing the consumption. In this embodiment example, said sealing lip 16 will bear pressure-sealingly against the flow pipe 10 upon relative movement along the entire length of the pipe 10, ensuring an intact pressure seal at all times.

Figure 7:
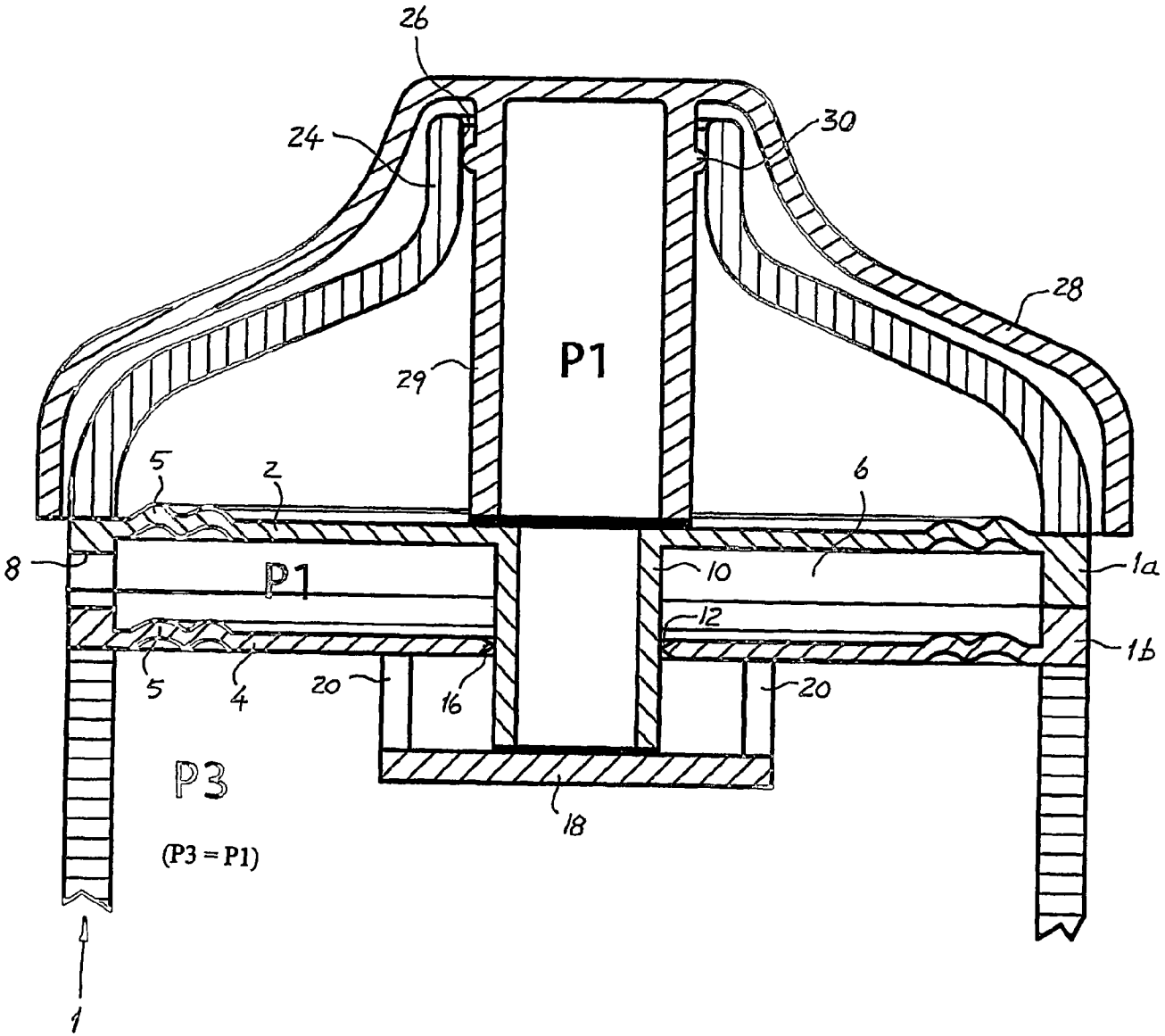
FIG. 7 shows the valve device according to FIG. 6, but in which the device also is shown connected to a drinking spout and an external protective cover.

FIG. 7 shows the valve device according to FIG. 6, but in here the outer cap part 1*a* is shown connected to a drinking spout 24 provided with an outflow opening 26, and also connected to an external protective cover 28. The cover 28 is provided with a centred, internal cover pipe 29 projecting inwards toward the valve device. The cover pipe 29 may be brought into contact with the outer membrane 2 for transport and storage, ensuring that the membranes 2, 4 are squeezed together temporarily, thus contributing to a secure closing of the valve device. The cover pipe 28 is provided with an external collar 30 that keeps the pipe 28 in place in the outflow opening 26.

FIG. 8 shows a third example of an embodiment according to the invention. However, this valve device is shown connected directly onto the outside of a wall of a drinking container 32, for example a drinking carton or a drinking pouch. The valve device is pressure-sealingly connected about a ring-shaped perforation demarcation line 34 in said wall, the demarcation line 34 defining an unpunctured puncture area 36 of the wall. Also in this example the membranes 2, 4 consist of flexible, circular surfaces that are substantially parallel and planar, and that are assembled at an axial distance from one another, thereby defining an intermediate reference pressure chamber 6. The outer membrane 2 is recessed within and connected to an outer spacer sleeve 38, while the inner membrane 4 is recessed within and connected to an inner spacer sleeve 40. The inner spacer sleeve 40 is placed at a radial distance inside of the outer spacer sleeve 38, thus providing an airflow passage 42 between sleeves 38, 40. The base of the inner spacer sleeve 40 has been expanded into an attachment collar 44 that is placed in a corresponding internal seating groove 46 in an outer collar 48 of the outer spacer sleeve 38. The base of the outer collar 48 is provided with an external flange 50 for connection to the drinking container 32. The collar 48 is also provided with vents 8 that allow for venting of the reference pressure chamber 6 via said airflow passage 42. Similar to the valve device according to FIG. 1, the valve device according to FIG. 8 is provided with an outer membrane 2 with a through-going, open flow pipe 10. The inner membrane 4 is provided with a central membrane opening 12, a secondary sealing body in the form of a sealing lip 16, and also a primary sealing body 18 and connecting stays 20 placed on the inside of membrane 4. In this example, the flow pipe 10 has a conical shape, tapering towards the free end thereof, and the flow pipe 10 is placed sealingly against the sealing lip 16 when the valve device is in a position of rest. Upon activation and opening of the valve device, the conical flow pipe 10 will move axially outwards relative to the sealing lip 16, whereby a vent gap 22 (not shown) is formed between these (cf. FIG. 4). When the conical flow pipe 10 moves axially outwards, the vent gap 22 will open further, admitting more air into the drinking container 32. Air thus may pass through the gap 22 during the liquid consumption. In this example, the sealing surface of the primary sealing body 18 is provided with a centring point 52. The other end of the sealing body 18 is formed as a perforation pin 54 placed in the immediate proximity of said puncture area 36 of the drinking container 32.

FIG. 9 shows the perforation pin 54 immediately after having pushed the puncture area 36 into the drinking container 32 by means of a finger 56 pressing on the outside of the outer membrane 2 and transmitting the required puncture force via the flow pipe 10. Thereby, the drinking container 32 is opened for access to the liquid therein.

FIG. 10 shows a fourth example of an embodiment of a valve device according to the invention, the valve device being associated with an internally threaded cap 58 that is connected to a bottleneck 60. In this example, the outer membrane 2 constitutes an extension of the cap 58, while the inner membrane 4 is provided with an external flange 62 that is fixed between the bottleneck 60 and the end wall 64 of the cap 58. In this area, the inside of the end wall 64 is provided with a peripheral venting slot 66. Venting to the reference pressure chamber 6 of the valve device takes place via the venting slot 66, and via openings between the threads of the cap 58 and the bottleneck 60. Thus, the venting is not obstructed by a user's lips enclosing the outer membrane 2 during valve-activation and consumption of liquid in the drinking container. Otherwise, the membranes 2, 4 and the flow pipe 10 are substantially similar to the corresponding components of FIG. 8, and they operate substantially in the same manner. However, the primary sealing body 18 according to FIG. 10 is not formed with a perforation pin 54.

FIG. 11 shows a fifth example of an embodiment of a valve device according to the invention, in which peripheral details of the membranes 2, 4 are identical to corresponding details in the valve device according to FIG. 8, and in which the valve device is shown in an inactive, valve-closing position of rest, and is connected to a non-pressurised drinking container. This valve device is different from the other embodiments in that a flow pipe 10 of uniform external diameter now is fixedly connected at the centre of the inner membrane 4, and is projecting at right angles therefrom, and in that the outer membrane 2 now is provided with the membrane opening 12 for the flow pipe 10, the primary sealing body 18 and the secondary sealing body 16. In this example, the inner end of the flow pipe 10 is pervasively open, while a curved sealing plate 68 closes off the outer end thereof. At its free, outer end and immediately inside of the sealing plate 68, the wall of the pipe 10 is provided with flow apertures 70. The membrane opening 12 in the outer membrane 2 is formed in and extends through a centred seal housing 72 of the outer membrane 2. On the inside and around the membrane opening 12, the seal housing 72 is provided with two flexible, ring-shaped sealing lips; which are an inner sealing lip constituting the secondary sealing body 16 of the device, and an outer sealing lip constituting the primary sealing body 18 of the device, respectively. At its position of rest, the outer sealing lip 18 is placed pressure-sealingly against the outside of said curved sealing plate 68, while the inner sealing lip 16 is placed pressure-sealingly against the base of the flow pipe 10.

FIG. 12 shows the valve device according to FIG. 11 in an active, valve-opening position, in which the outer membrane 2 has moved outwards and bulges under the influence of a user-applied underpressure P2 acting on the outside thereof. In this position, the outer sealing lip 18 is separated from the sealing plate 68, allowing liquid to flow out between these via said flow apertures 70 in the pipe 10. Downstream-directed arrows indicate the liquid outflow direction. In the valve-activated position, the inner sealing lip 16 still is placed pressure-sealingly against the flow pipe 10 in an area immediately inside of the flow apertures 70, with venting of the reference pressure chamber 6 taking place via said airflow passage 42 and vents 8 in the collar 48.

The invention claimed is:

1. A valve device for preventing unintentional fluid outflow from a drinking container, the device being underpressure-activated and, when in position of use, being connected to an outflow opening in the container, wherein the device consists of two flexible pressure-sensitive membranes constituting an outer membrane and an inner membrane, respectively, that are placed at an axial distance from one another, and their peripheral attachment areas are pressure-sealingly interconnected, the constellation of which defines an intermediate reference pressure chamber, and that the chamber is provided with at least one vent placed outside of the activation surfaces of the membranes and in communication with an ambient pressure P1, and that one of the two membranes is fixedly connected to a through-put flow pipe for said fluid, and that the other of the two membranes is provided with a through-going membrane opening within which the pipe is movably arranged, and that the membrane opening is associated with a primary sealing body arranged to seal against fluid flow via the pipe, and with a secondary sealing body arranged to provide a seal between the chamber and an internal pressure P3 in the container, and that both sealing bodies are placed in pressure-sealing contact with the pipe when the valve device is in an inactive position of rest, while at least the primary sealing body is placed in an open position when the valve device is in an active position, the valve device being activated by applying an underpressure P2 to the outside of the outer membrane and moving it relative to the inner membrane.

2. A valve device according to claim 1, wherein the flow pipe is fixedly connected to the outer membrane, while the inner membrane is provided with the membrane opening for the pipe and also associated with the primary sealing body and the secondary sealing body.

3. A valve device according to claim 2, wherein the secondary sealing body is a flexible, ring-shaped sealing lip arranged about the membrane opening.

4. A valve device according to claim 2, wherein the flow pipe has a reduced outer diameter in at least the free end portion thereof, whereby a vent gap is formed between the flow pipe and the secondary sealing body when the sealing body, upon activation of the valve device, is placed directly opposite a pipe length section having a reduced outer diameter, thereby allowing venting from the reference pressure chamber to the drinking container.

5. A device according to claim 4, wherein the inwardly projecting free end portion of the flow pipe is provided with a recessed area having a uniformly reduced outer diameter.

6. A valve device according to claim 2, wherein the primary sealing body consists of a sealing plate that is placed on the inside of the inner membrane, and that is connected to the inner membrane by means of at least one stay by-passable to flow, the sealing plate having a shape that causes pressure-sealing when bearing against the inwardly projecting, free end portion of the flow pipe.

7. A valve device according to claim 6, wherein the secondary sealing body is a flexible, ring-shaped sealing lip arranged about the membrane opening.

* * * * *